US011819136B2

(12) United States Patent
McGuire

(10) Patent No.: US 11,819,136 B2
(45) Date of Patent: Nov. 21, 2023

(54) MATTRESS ASSEMBLIES INCLUDING ANTIVIRAL PROTECTION

(71) Applicant: Dreamwell, Ltd., Doraville, GA (US)

(72) Inventor: Sheri L. McGuire, Duluth, GA (US)

(73) Assignee: DREAMWELL, LTD., Doraville, GA (US)

( * ) Notice: Subject to any disclaimer, the term of this patent is extended or adjusted under 35 U.S.C. 154(b) by 156 days.

(21) Appl. No.: 17/217,313

(22) Filed: Mar. 30, 2021

(65) Prior Publication Data

US 2021/0298489 A1 Sep. 30, 2021

Related U.S. Application Data

(60) Provisional application No. 63/002,942, filed on Mar. 31, 2020.

(51) Int. Cl.
*A47C 31/00* (2006.01)
*A47C 27/00* (2006.01)
(Continued)

(52) U.S. Cl.
CPC ..... *A47C 31/007* (2013.01); *A47C 27/002* (2013.01); *A47C 27/14* (2013.01);
(Continued)

(58) Field of Classification Search
CPC ..... A01N 55/00; A01N 59/16; A47C 31/001; A47C 27/002; A47C 31/007; A47C 27/144; A47C 27/148; A47C 27/15; A47C 21/046; A47C 27/007; A47C 27/122; A47C 31/105; A47C 21/04; A47C 27/14; B32B 2260/021; B32B 2262/04; B32B 2262/062; B32B 2307/3065; B32B 2307/728; B32B 2601/00; B32B 5/18; B32B 5/245; B32B 5/26; B32B 2250/05; B32B 2250/20; B32B 2255/02; B32B 2255/205; B32B 2255/26; B32B 2255/28; B32B 2260/048; B32B 2262/0253; B32B 2262/0276; B32B 2262/065; B32B 2307/21; B32B 2307/304; B32B 2307/7145; B32B 2307/718; B32B 2307/7242; B32B 2307/7265;
(Continued)

(56) References Cited

U.S. PATENT DOCUMENTS

2010/0096586 A1 4/2010 Mikkelsen
2014/0326192 A1 11/2014 Coupe et al.
(Continued)

FOREIGN PATENT DOCUMENTS

CN 101874691 A 11/2010

OTHER PUBLICATIONS

International Search Report and Written Opinion for Application No. PCT/US2021/025157 dated Jul. 12, 2021, 14 pages.

*Primary Examiner* — David R Hare
*Assistant Examiner* — Madison Emanski
(74) *Attorney, Agent, or Firm* — CANTOR COLBURN LLP

(57) ABSTRACT

Antiviral-treated fabric layers for mattress assemblies includes a silver halide and liposome carrier. Additionally, the envelope encapsulating a cushioning material can include an antiviral-treated fabric. The antiviral-treated fabric can include silver halide and a liposome carrier, wherein the liposome carrier is a vesicle.

17 Claims, 2 Drawing Sheets

(51) Int. Cl.

| | |
|---|---|
| ***A47C 27/14*** | (2006.01) |
| ***A47G 9/00*** | (2006.01) |
| ***A47G 9/10*** | (2006.01) |
| ***B68G 7/10*** | (2006.01) |

(52) U.S. Cl.
CPC ..... *A47G 9/007* (2013.01); *A47G 9/10* (2013.01); *B68G 7/10* (2013.01)

(58) Field of Classification Search
CPC ..... B32B 2307/73; B32B 2437/02; B32B 2479/00; B32B 5/022; B32B 5/06; B32B 5/08; B32B 7/09; D04H 1/74; D04H 1/02; D04H 1/425; D04H 1/4258; D04H 1/4291; D04H 1/435; D04H 1/43828; D04H 1/43835; D04H 1/587; D10B 2503/06; A47G 9/10; A47G 2009/1018; A47G 9/0253
See application file for complete search history.

(56) References Cited

U.S. PATENT DOCUMENTS

| | | | | |
|---|---|---|---|---|
| 2015/0265063 | A1* | 9/2015 | Cappadona ..... | A47C 31/001 5/724 |
| 2015/0329997 | A1 | 11/2015 | Switzer et al. | |
| 2018/0368417 | A1* | 12/2018 | Niedermeyer ..... | A61K 33/24 |

* cited by examiner

MATTRESS ASSEMBLIES INCLUDING ANTIVIRAL PROTECTION

CROSS-REFERENCE TO RELATED APPLICATIONS

This application claims the benefit of U.S. Provisional Application Ser. No. 63/002,942, filed on Mar. 31, 2020, which is expressly incorporated by reference herein in tis entirety.

BACKGROUND

The present disclosure generally relates to a mattress assembly including antiviral protection. More specifically, the mattress assemblies include silver-based antiviral coatings on user contact surfaces such as the mattress ticking, pillowcases, mattress protector, and the like.

Viruses are extremely small and infectious substances that reproduce by invading a living host cell. The host cell replicates and releases the new viruses, which go on to infect other cells. Viruses usually infect specific cell types. Many pathogenic viruses are enveloped by a lipid membrane. The lipid membrane protects the genetic material inside the virus and provides additional functions for cell attachment, morphogenesis and transmission. Enveloped viruses represent more than 60% of all existing viruses and include major human pathogens. Many viruses are pathogens that can lead to severe sickness and mortality. Non-limiting examples include coronavirus, human and avian influenzas, H1N1, H5N1, H7N9, respiratory syncytial virus, herpes, hepatitis and HIV-AIDS. Thousands of deaths every year result from transmission of pathogenic viruses. Viruses can persist on surfaces and remain infectious for days, wherein contaminated textiles can act as a surface for transmitting pathogens.

With regard to coronaviruses, these types of viruses are generally known and as evidenced by the recent pandemic in 2019-20, some of these viruses such as human coronavirus (SARS-CoV) can cause severe illness and/or death amongst vulnerable population groups. Viruses as well as bacteria can remain on textile surfaces for days to months. For example, the SARS-CoV virus has been found to persist for up to 2 days or more at room temperature on surgical gowns for those medical professionals treating infected patients.

BRIEF SUMMARY

Disclosed herein are mattress assemblies and peripheral accessories that can be formed of an antiviral treated fabric or foam depending on the layer composition. By way of example, the ticking layer, foam layers, pillowcase envelopes, pillowcases, linens, and the like and the like can be formed of antiviral treated fabrics including a silver halide and a liposome vesicle carrier.

In one or more embodiments, a mattress assembly includes a ticking layer including a silver-based material on a top surface facing an end user when the mattress assembly is in use, wherein the silver-based material includes a plurality of vesicular carriers including silver ions disposed therein, wherein the vesicular carrier is a cholesterin depleting lipid vesicle; and a base core layer, wherein the ticking layer overlies a top surface of the base core layer and defines an outermost surface of the mattress assembly.

In one or more embodiments, the mattress assembly can include a base core having an upper primary surface; a mattress panel overlying the upper primary surface of the base core including an antiviral-treated fabric layer including a silver-based material including a plurality of vesicular carriers including silver ions disposed therein, wherein the vesicular carrier is a cholesterin depleting lipid vesicle, and a filler layer disposed below the fabric layer, wherein the fabric layer, and filler layer are joined at a respective edge.

A pillow includes an outer envelope; and a cushioning material encapsulated within the envelope, wherein the outer envelope includes an antiviral treated fabric including a silver-based material including a plurality of vesicular carriers including silver ions disposed therein, wherein the vesicular carrier is a cholesterin depleting lipid vesicle.

The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Figure 1:
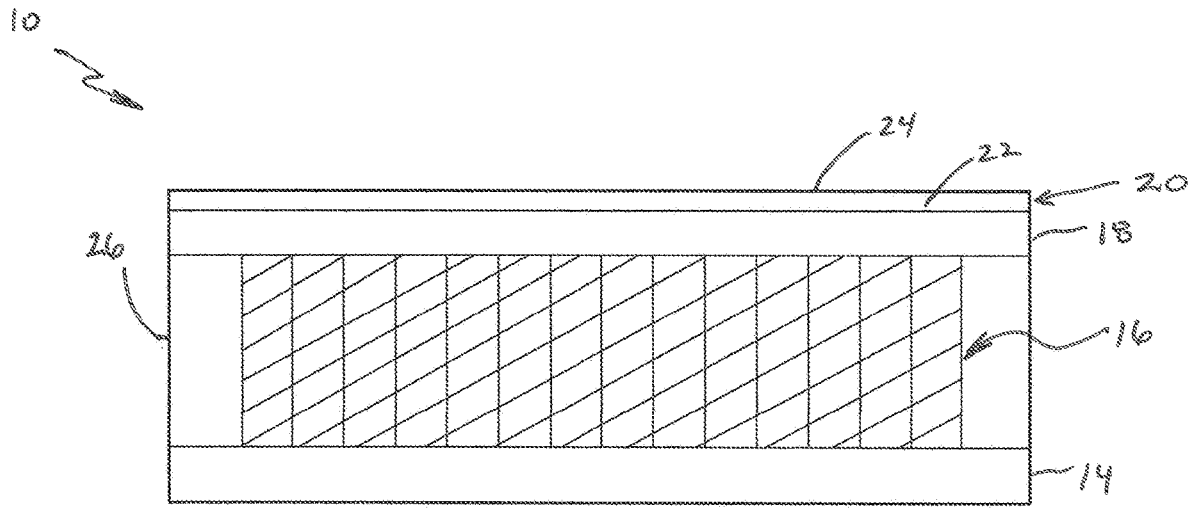
FIG. 1 illustrates a cross sectional view of a one-sided mattress assembly including a vesicular carrier containing silver on a user contact surface in accordance with the present disclosure.

Disclosed herein are mattress assemblies including antiviral protection on user contact surfaces such as pillowcases, mattress ticking, sheets, comforters and the like. As will be discussed in greater detail below, the antiviral protection is a silver-based material that can be applied to woven or non-woven fabrics defining the user contact surfaces for the mattress assemblies. By way of example, the silver-based materials can be applied to facing surfaces of fabrics defining the uppermost mattress layer such as a non-removable and non-washable mattress ticking, pillow casing, sheeting, comforters, or to other layers proximate to the user contact surface, e.g., fiber fill utilized in pillows, padding layer underlying the mattress ticking, foam layer, and the like.

The silver-based materials generally include a vesicular carrier containing silver, wherein the silver is in the form of silver ions to attract an oppositely charged virus and permanently bind the virus via negatively charged sulfur bearing groups present in the viral membrane. The viral membrane, also referred to as capsid, houses the genetic viral material. The viral membrane can include negatively charged pendant sulfur moieties. Once the virus is attracted and the positively charged silver-containing material is bound to the virus, the vesicular carrier is configured to deplete the viral lipid membrane of its cholesterol content, which exposes and destroys the virus within the protein membrane through the direct contact. Advantageously, the silver ions also provide antibacterial properties.

In one or more embodiments, the vesicular carrier can be a spherical liposome such as those commercially available from HeiQ under the tradename Viroblock. The spherical liposomes can be natural or synthetic. The synthetic or natural liposomes typically consist of a hydrophilic head and one or more hydrophobic tails. In a water solution, the liposomes self-assemble into highly flexible bilayer vesicles, wherein the hydrophilic head including the silver ions face the water. The silver-based material can be applied directly to the user contact surfaces of the mattress assembly. In one or more embodiments, the silver-based materials are applied to the ticking layer, which is generally defined as the outermost layer of the mattress assembly and can be quilted or non-quilted as may be desired for different mattress assemblies. In one or more embodiments, the vesicular carrier is a cholesterine depleting lipid vesicle.

The mattress assemblies may be of any size, including standard sizes such as a twin, queen, oversized queen, king, or California king sized mattress, as well as custom or non-standard sizes constructed to accommodate a particular user or a particular room. The mattress assemblies are generally configured as one sided.

Referring now to Figure ("FIG.") 1, there is depicted a cross sectional view of a one-sided mattress assembly 10 including a "treated surface" including a plurality of vesicular carriers containing silver ions. The exemplary mattress assembly 10 generally includes a bottommost foam layer 14, base core layer 16 on the bottommost foam layer 14, at least one or more foam layers 18 overlying the base core layer 16, one of which is shown, and a ticking layer 20. The mattress assembly 10 can further include a side rail assembly 26 as shown about at least a portion of the perimeter of the mattress core 16. As depicted, the side rail assembly 26 and the bottommost foam layer 14 collectively form a so-called bucket assembly so as to provide a cavity for seating the base core layer 16.

The ticking layer 20 generally includes a fabric covering 24 and at least one foam or fiber padding layer 22. The ticking layer 20 is generally referred to herein as the cover layer for the mattress assembly and has a planar top surface adapted to substantially face the user resting on the mattress assembly and have length and width dimensions sufficient to support a reclining body of the user. The fabric layer can be any desired sheet of material, such as cotton, linen, synthetic fibers or a mixture thereof. The ticking layer 20 can be quilted or non-quilted. Additionally, the ticking layer 20 can include additional layers such as a flame-retardant layer and/or backing layers (not shown). The various layers can be fixedly attached to one another by stitching, an adhesive, or the like to define a panel, which can be removable or non-removable, or can be individual layers.

In some embodiments, the base core layer 16 can be an innerspring assembly as shown in which case the bottommost foam layer 14 is typically provided. Alternatively, the base core layer 16 can be a foam layer (not shown).

In one or more embodiments, the outwardly facing surface of the ticking layer, i.e., the fabric covering 24, includes a coating and/or fibers that are treated with silver-based materials, which generally include a vesicular carrier containing silver, wherein the silver is in the form of silver ions to attract an oppositely charged virus. In one or more embodiments, the underlying foam or fiber padding layer is also treated with the silver-based materials, which in some embodiments, is limited to the uppermost surface. It has been found that the silver-based materials can effectively provide antiviral as well as antibacterial protection.

Figure 2:
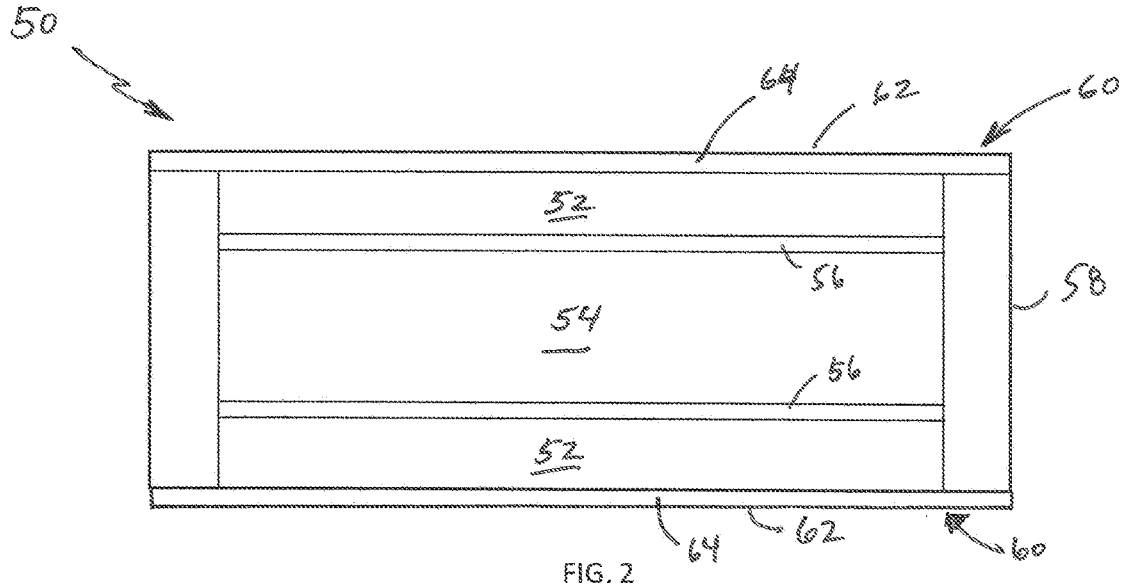
FIG. 2 illustrates a cross-sectional view of a two-sided mattress assembly including antiviral protection in accordance with the present disclosure.

Referring now to FIG. 2, there is depicted a cross sectional view of an exemplary two-sided mattress assembly, which is generally designated by reference numeral 50. Relative to ground level, the exemplary mattress assembly 50 generally includes a base core layer 54 sandwiched between one or more foam layers 52. Ticking layers 60 are provided on at least the uppermost and bottommost surfaces 52 of the mattress assembly 50. In one or more embodiments, a single ticking layer 60 is utilized and encapsulates the entire mattress assembly, which can include a zippered opening (not shown) for removal therefrom, if desired. Similar to the one-sided mattress assembly 10 described above, in some embodiments, there may be one or more intermediate layers 56 sandwiched between the base core layer 54 and the uppermost or the bottommost foam layers 52. The mattress assembly may further include a side rail assembly 58 about at least a portion of the perimeter of the mattress layers. The ticking layer includes and fabric covering 62 and a foam or fiber padding 64 as previously described. In one or more embodiments, the outermost surface of the fabric covering 62 or the fibers defining the fabric covering 62 are coated with silver based material to provide the two-sided mattress with antiviral and antibacterial properties.

It is to be understood that the base core layers 16, 54 of the mattress assemblies 10, 50, respectively, described above can be any suitable base known to those having skill in the art. The base core layer 16, 54 can be a standard spring support unit (e.g., a pocketed coil base or an innerspring assembly such as is shown in FIG. 1) or, alternatively, the base core layer 16, 54 can be formed of foam as shown in FIG. 2, e.g., a polyurethane foam, although other foams can be used, including without limitation, viscoelastic foams, or a hybrid thereof. In one embodiment, the base core layer is an open cell polyurethane foam. In other embodiments, the base core layer is closed cell polyurethane foam.

The different properties for each layer defining the foam may include, but are not limited to, density, hardness, thickness, support factor, flex fatigue, air flow, various combinations thereof, and the like. Density is a measurement of the mass per unit volume and is commonly expressed in pounds per cubic foot. By way of example, the density of the each of the foam layers can vary. In some embodiments, the density decreases from the lower most individual layer to the uppermost layer. In other embodiments, the density increases. In still other embodiments, one or more of the foam layer can have a convoluted surface. The convolution may be formed of one or more individual layers with the foam layer, wherein the density is varied from one layer to the next. The hardness properties of foam are also referred to as the indention load deflection (ILD) or indention force deflection (IFD) and are measured in accordance with ASTM D-3574. Like the density property, the hardness properties can be varied in a similar manner. Moreover, combinations of properties may be varied for each individual layer. The individual layers can also be of the same thickness or may have different thicknesses as may be desired to provide different tactile responses.

The hardness properties of the layers generally have an indention load deflection (ILD) of 7 to 22 pounds force for viscoelastic foams and an ILD of 7 to 45 pounds force for non-viscoelastic foams. ILD can be measured in accordance with ASTM D 3575. The density of the layers can generally range from about 1 to 2.5 pounds per cubic foot for non-viscoelastic foams and 1.5 to 7 pounds per cubic foot for viscoelastic foams.

Suitable foams for the different layers that include foam, include but are not limited to, polyurethane foams, latex foams including natural, blended and synthetic latex foams; polystyrene foams, polyethylene foams, polypropylene foam, polyether-polyurethane foams, and the like. Likewise, the foam can be selected to be viscoelastic or non-viscoelastic foams. Some viscoelastic materials are also temperature sensitive, thereby also enabling the convoluted foam layer to change shape based in part upon the temperature of the supported part. Any of these foams may be open celled or closed cell or a hybrid structure of open cell and closed cell. Likewise, the foams can be reticulated or partially reticulated or non-reticulated. Still further, the foams may be gel infused in some embodiments. The term reticulation generally refers to removal of cell membranes to create an open cell structure that is open to air and moisture flow. The different layers can be formed of the same material configured with different properties or different materials.

The innerspring assembly can include a plurality of coil springs, which are not intended to be limited to any specific type or shape. The coil springs can be single stranded or multi-stranded, pocketed or not pocketed, asymmetric or symmetric, and the like. It will be appreciated that the pocket coils may be manufactured in single pocket coils or strings of pocket coils, either of which may be suitably employed with the mattresses described herein. The attachment between coil springs may be any suitable attachment, e.g., the coil springs may optionally be encased, i.e., pocketed, in an envelope or an open coil and arranged in rows. For example, pocket coils are commonly attached to one another using hot-melt adhesive applied to abutting surfaces during construction.

The construction of the coil spring layer may be a plurality of rows of parallel coils with the coils aligned in columns so that the coils line up in both longitudinal and lateral directions or they may be nested in a honeycomb configuration, wherein coils in one row are offset from coils in an adjacent row as is generally known in the art. Adjacent spring coils may be connected with adhesive. Alternatively, adjacent spring coils may be connected with a hog ring or other metal fasteners.

As is generally known in the art, the coils can be of any diameter; be symmetrical or asymmetrical, be designed with linear and/or non-linear behavior, or the like as may be desired for the different intended applications. In one embodiment, the length of the coil springs ranges from 1 to 10 inches; and 2 to 6 inches in other embodiments.

The coils in the innercore coil spring layer 14 can have a coil gauge is about 12 to about 16 and the density of coils within a mattress generally ranges from about 400 to about 2,000. The standard size generally ranges from about 4 inches to about 12 inches. Typically, the standard height is about 8 inches. For many years, one form of spring assembly construction has been known as Marshall Construction. In Marshall Construction, individual wire coils are each encapsulated in fabric pockets and attached together in strings which are arranged to form a closely packed array of coils in the general size of the mattress. Examples of such construction are disclosed in U.S. Pat. Nos. 685,160, 4,234,983, 4,234,984, 4,439,977, 4,451,946, 4,523,344, 4,578,834, 5,016,305 and 5,621,935, the disclosures of which are incorporated herein by reference in their entireties.

The coil springs are not intended to be limited to any specific type or shape. The coil springs can be single stranded or multi-stranded, pocketed or not pocketed, asymmetric or symmetric, and the like. It will be appreciated that the pocket coils may be manufactured in single pocket coils or strings of pocket coils, either of which may be suitably employed with the mattresses described herein. The attachment between coil springs may be any suitable attachment. For example, pocket coils are commonly attached to one another using hot-melt adhesive applied to abutting surfaces during construction.

The proposed coil spring construction for use in the mattress assembly can employ a stranded wire spring which is made of at least 2 wire strands that are twisted to form a multi-wire cord. The number of strands employed will vary according to the application and may vary based on the type of material used to form the strand. Thus, the wire may include two or more strands, and can include from three to fifty strands.

The strands may be twisted, weaved, clipped or bonded together and any suitable method for forming the stranded wire spring may be employed without departing from the scope of the invention. The strands may be steel, aluminum, plastic, copper, titanium, rubber or any other suitable material and the type of material selected will depend upon the application at hand. Moreover, the strands may have any suitable shape and may be long cylindrical wires, hexagonal wire, square wire or any other shape or geometry. Additionally, the wire strand gauge may vary according to the application and in one embodiment comprises 710-gauge wire, although other gauges may be used.

In one practice, coiling may be achieved construction by passing a braided strand through a coiler, such as the type of coiler employed for forming steel mattress coils wherein a heavy-gauge steel wire is compressed into a barrel-shaped coil such that no turns touch for eliminating noise and vibration. The coils may then be passed to a pocketing machine or station to pocket the springs into individual sleeves of a non-woven, non-allergenic fabric such as Duon. Each sleeve may be ultrasonically sealed, a process where the fibers are melted together to form solid plastic seams that are secure and tear-resistant. The coils are then fusion bonded to produce a strong, stable construction. The number of coils in each unit may vary, and the types of coils and the number of strands and gauge of strands can vary from pocket to pocket.

The individual strands are connected with each other at least at the ends of the coil. Since the strands can rub against each other over the length of the coil, which can cause fretting and premature wear, the strands may be coated and/or pre-galvanized. Moreover, the stranded coil may also be sealed with a sealant, such as an epoxy. Thus, in alternative and optional embodiments, the strands may be coated or otherwise treated and the wire may be sealed or coated. Exemplary stranded wire for use in mattresses is disclosed in U.S. Pat. Nos. 7,047,581, 7,168,117, and 8,099,811 incorporated herein by reference in its entireties.

Figure 3:
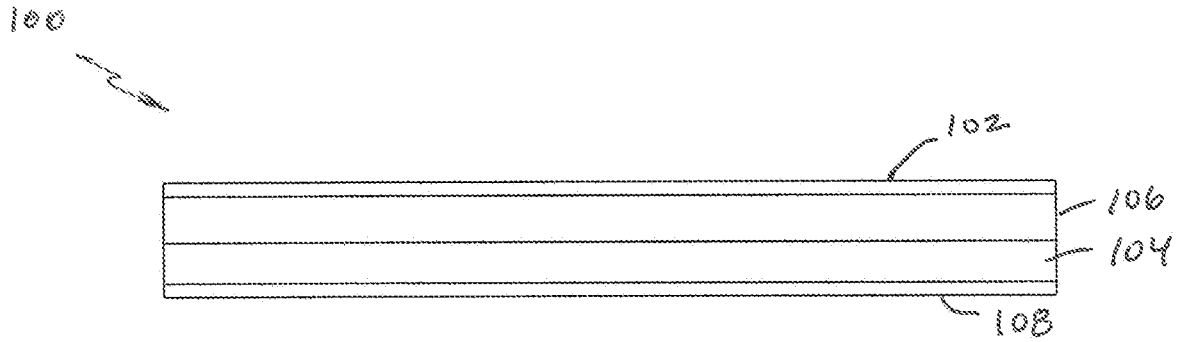
FIG. 3 illustrates a cross-sectional view of a sheet panel for overlying a mattress assembly including a vesicular carrier containing silver on a user contact surface in accordance with the present disclosure.

FIG. 3 illustrates a cross-sectional view of a portion of a removable panel 100 including antiviral protection. The removable panel can be quilted or non-quilted and to the form of a comforter, sheet or the like. The panel 100 includes an antiviral-treated fabric layer 102, which serves as the topmost layer in the panel. The fabric layer 102 may be any desired sheet of material, such as cotton, linen, synthetic fibers or a mixture thereof. When a mattress is assembled, the top layer 102 is an outer surface of the mattress, i.e., the mattress ticking layer as described above or can be a comforter, sheet or the like that is used as an outermost covering of the mattress sleeping surface. In one or more embodiments, the panel 100 can further include a filler layer 104 underlying the fabric layer 102. The filler layer is a cushioning layer and may be formed from any padding material, such as foam, cotton batting, gel, latex, viscoelastic foam or other known padding materials and or combination of padding materials. The filler layer 104 may be from about 0.25 inches to about 5 inches in height, preferably from about 1 inch to about 4 inches. In one preferred embodiment, the filler layer may be a foam substantially 3 inches in height with an ILD of 12 and a density of 1.2. However, in other embodiments, the ILD may be different from this preferred embodiment and the density and ILD can vary according to the application. In certain embodiments the density can range from about 1.0 to about 5.0 and the ILD can vary from, for example, about 10 to about 40 ILD. Other values may also be used without departing from the scope of the invention. The filler layer 104 may have a substantially flat, smooth upper surface or may have a textured or patterned upper surface. The filler layer 104 may have multiple zones of different properties, including a lumbar zone and a shoulder zone. For example, in one embodiment, the panel has a foam filler layer 104 that includes a layer of gel material that is formed within the foam layer and that extends from one side of the mattress to the other side, providing a zone of gel material at an area where the lumbar of a sleeping user would be positioned. The number of zones and the location of the zones may vary according to the application.

A fire-resistant layer 106 may be placed between the filler layer 104 and the fabric layer 102. In the depicted embodiment, the fire-resistant layer 106 includes a barrier fabric 24 which can be incorporated in the panel structure between the fabric layer 102 and the filler layer 104, as shown. However, in the other embodiments, the fire-resistant layer may be a sock-like enclosure that fits over and around the filler layer to protect all sides of the filler layer 104 from heat, fire, and flame.

Optionally, the fire barrier fabric 106 can also be attached to one of the layers, for example, the top layer 102, with an adhesive. The fire barrier fabric 106, when used as the backing material, can significantly reduce the fire hazard due to the material properties of the fire barrier fabric 106 that will hinder the propagation of a fire to the mattress body. For added fire protection, the fire barrier fabric 106 can also be placed directly under a border ticking.

The panel 100 can further include a backing layer, wherein the fabric layer 102, fire resistant layer 106, filler layer 104 and backing layer are stitched about a perimeter to form a cohesive unit. In one or more embodiments, the panel is joined together by stitching, gluing, stapling, tying, or melting and can be joined to the border ticking covering the sides of the mattress assembly.

Figure 4:
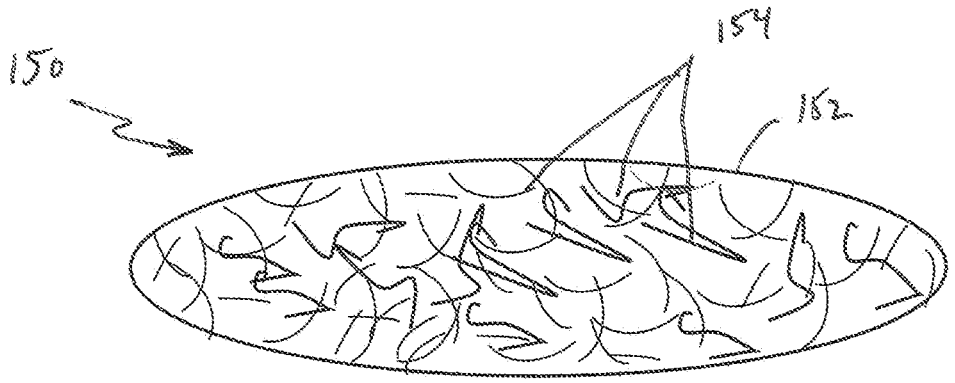
FIG. 4 illustrates a cross-sectional view of a pillow including a pillowcase including a vesicular carrier containing silver on a user contact surface in accordance with the present disclosure.

In one or more other embodiments, FIG. 4 illustrates a pillow 150 can include an envelope 152 fabric treated with the silver-based material as described above. In one or more embodiments, the outer surfside of the envelope is coated with the silver-based material. A cushioning material 154 is disposed within the envelope and is completely encapsulated by the envelope. The cushioning material is not intended to be limited and can include foam, feathers, fiber padding or the like. Optionally, the envelope 52 can include a zippered opening to access the cushioning material. The pillow can further include a pillowcase as may be desired for aesthetic and comfort purposes. The pillowcase can also be treated with the silver-based material in the manner described above.

The antiviral-treated fabric in the above embodiments can be formed by coating the individual fibers defining the fabric, individually or in combination with other chemistries, e.g., flame retardants, stain inhibitors, phase change materials, dyes, fragrances, and the like; by immersing the completed fabric layer in a solution containing the silver-based antiviral; or by spraying a surface with the antiviral. In one or more embodiments, the silver-based material is deposited onto the fabric in a range of about 5 to about 20 percent by weight of the fabric. The silver particles can have a diameter in a range of about 1 nanometer (nm) to about 10 nm.

It should be apparent that the pillowcase and various linens used in conjunction with the mattress assembly can be fabricated with the antiviral-treated fabric as described above. Likewise, the various layers defining the mattress assembly as generally described above can include the antiviral treatment including but not limited to the fabric layers, the fire-retardant sock, border ticking, and backing layers.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly comprising:

a ticking layer comprising a silver-based material on a user contact surface when the mattress assembly is in use, wherein the silver-based material comprises a plurality of vesicular carriers including silver ions disposed therein, wherein the vesicular is a cholesterin depleting lipid vesicle; and a base core layer, wherein the ticking layer overlies a top surface of the base core layer and defines an outermost surface of the mattress assembly.

2. The mattress assembly of claim 1, wherein the silver based material comprises silver halide.

3. The mattress assembly of claim 1, wherein the mattress assembly is a two-sided mattress.

4. The mattress assembly of claim 1, wherein the mattress assembly is one-sided mattress.

5. The mattress assembly of claim 1, wherein the ticking layer comprises a fabric covering, wherein at least a portion of the fabric covering or fibers defining the fabric covering comprise the silver-based material.

6. The mattress assembly of claim 1, further comprising a base core layer comprising an innerspring assembly, wherein the ticking layer overlies the base core layer.

7. The mattress assembly of claim 1, further comprising a base core layer comprising one or more foam layers, wherein the ticking layer overlies the base core layer.

8. The mattress assembly of claim 1, wherein the silver-based material is in a range of about 5 to about 20 percent by weight of fabric.

9. A mattress assembly, comprising, a base core having an upper primary surface, a mattress panel overlying the upper primary surface of the base core comprising, an antiviral-treated fabric layer comprising a silver-based material including a plurality of vesicular carriers including silver ions disposed therein, wherein the vesicular carrier is a cholesterin depleting lipid vesicle, and a filler layer disposed below the fabric layer, wherein the fabric layer, and filler layer are joined at a respective edge.

10. The mattress assembly of claim 9, further comprising a fire resistant layer within the mattress panel intermediate the filler layer and the antiviral-treated fabric layer and being joined at the respective edge.

11. The mattress assembly of claim 9, further comprising a backing layer underlying the filler layer and being joined at the respective edge.

12. The mattress assembly of claim 11, wherein at least two of the fabric layer, filler layer, and backing layer are joined together by stitching, gluing, stapling, tying, or melting.

13. The mattress assembly of claim 9, wherein the base core comprises a core selected from the group of innersprings, pocketed innersprings, viscoelastic foam, latex foam, polyurethane foam and combinations thereof.

14. The mattress assembly of claim 9, wherein the mattress panel is configured to be removable from the mattress assembly.

15. The mattress assembly of claim 9, wherein the mattress panel comprises a comforter.

16. The mattress assembly of claim 9, wherein the silver-based material is in a range of about 5 to about 20 percent by weight of fabric layer.

17. The mattress assembly of claim 9, wherein the mattress panel comprises a mattress protector.

* * * * *